US008899338B2

(12) United States Patent
Elsayed et al.

(10) Patent No.: US 8,899,338 B2
(45) Date of Patent: Dec. 2, 2014

(54) METHOD AND APPARATUS FOR INSTALLING A WIRELINE FOR LOGGING OR OTHER OPERATIONS IN AN UNDER-BALANCED WELL

(75) Inventors: Salem Lotfi Elsayed, Hurghada (EG); Waqar Khan, Lahore (PA)

(73) Assignee: Schlumberger Technology Corporation, Sugar Land, TX (US)

( * ) Notice: Subject to any disclaimer, the term of this patent is extended or adjusted under 35 U.S.C. 154(b) by 240 days.

(21) Appl. No.: 13/002,819

(22) PCT Filed: Jul. 20, 2009

(86) PCT No.: PCT/EP2009/005564

§ 371 (c)(1), (2), (4) Date: Apr. 7, 2011

(87) PCT Pub. No.: WO2010/012487

PCT Pub. Date: Feb. 4, 2010

(65) Prior Publication Data

US 2011/0174503 A1 Jul. 21, 2011

(30) Foreign Application Priority Data

Jul. 31, 2008 (EP) ..... 08290743

(51) Int. Cl.

| | |
|---|---|
| ***E21B 19/00*** | (2006.01) |
| ***E21B 33/06*** | (2006.01) |
| ***E21B 17/00*** | (2006.01) |
| ***E21B 17/02*** | (2006.01) |
| ***E21B 33/08*** | (2006.01) |
| ***E21B 33/072*** | (2006.01) |
| *E21B 21/00* | (2006.01) |

(52) U.S. Cl.

CPC ..... *E21B 17/025* (2013.01); *E21B 33/085* (2013.01); *E21B 2021/006* (2013.01); *E21B 33/06* (2013.01); *E21B 33/072* (2013.01)

USPC ..... 166/385; 166/85.4; 166/242.6

(58) Field of Classification Search

USPC ..... 166/385, 77.1, 242.5, 85.4, 95.1, 334.2, 166/242.2, 242.6; 251/1.1; 277/330, 334

See application file for complete search history.

(56) References Cited

U.S. PATENT DOCUMENTS

| | | | | |
|---|---|---|---|---|
| 2,153,852 | A * | 4/1939 | Tschappat | 277/330 |
| 3,917,008 | A * | 11/1975 | Suter | 175/38 |
| 4,506,729 | A * | 3/1985 | Davis et al. | 166/66.5 |
| 4,699,216 | A | 10/1987 | Rankin | |
| RE33,150 | E * | 1/1990 | Boyd | 166/242.5 |
| 5,012,865 | A * | 5/1991 | McLeod | 166/90.1 |
| 5,435,395 | A * | 7/1995 | Connell | 166/384 |
| 5,941,310 | A | 8/1999 | Cunningham et al. | |
| 6,186,239 | B1 * | 2/2001 | Monjure et al. | 166/384 |
| 6,315,046 | B1 * | 11/2001 | Jack et al. | 166/312 |
| 6,457,530 | B1 * | 10/2002 | Lam et al. | 166/368 |

(Continued)

*Primary Examiner* — Kenneth L Thompson
*Assistant Examiner* — Michael Wills, III

(57) ABSTRACT

An improved apparatus and a method to insert a wireline through a blow out preventer to log an underbalanced open hole well without killing the well or causing formation damage while maintaining well control during the process. A dual throated blow out preventer (10) provides a moveable sealing element (1210, 1402) to allow a wireline (13) and a drill string (25) to be placed in a well for assembly, then seals off the dual throat to isolate the drill string from the wireline, thereby permitting pressure to be maintained on both the wireline through a standard packoff arrangement (1218) and on the drill string using the rams of the blow out preventer (10).

9 Claims, 4 Drawing Sheets

(56) References Cited

U.S. PATENT DOCUMENTS

| | | | | |
|---|---|---|---|---|
| 6,845,958 | B2 * | 1/2005 | Wood et al. | 251/1.1 |
| 6,851,478 | B2 * | 2/2005 | Cornelssen et al. | 166/368 |
| 6,920,931 | B1 * | 7/2005 | Webre et al. | 166/379 |
| 6,964,306 | B2 * | 11/2005 | Bunney | 166/382 |
| 7,261,155 | B1 * | 8/2007 | Ward et al. | 166/242.5 |
| 7,281,589 | B2 * | 10/2007 | Robichaux et al. | 166/386 |
| 7,377,316 | B2 * | 5/2008 | Boyd | 166/242.5 |
| 7,464,765 | B2 * | 12/2008 | Isaacks et al. | 166/378 |
| 7,503,397 | B2 * | 3/2009 | Giroux et al. | 166/385 |
| 7,770,653 | B2 * | 8/2010 | Hill et al. | 166/379 |
| 7,814,972 | B2 * | 10/2010 | Angman et al. | 166/77.52 |
| 2005/0133227 | A1 | 6/2005 | Wills | |
| 2006/0102359 | A1 * | 5/2006 | Brown et al. | 166/379 |
| 2007/0095544 | A1 * | 5/2007 | Boyd | 166/385 |
| 2007/0158078 | A1 | 7/2007 | Boyd | |
| 2010/0018721 | A1 * | 1/2010 | Jennings et al. | 166/385 |
| 2011/0056681 | A1 * | 3/2011 | Khan | 166/254.2 |

* cited by examiner

FIG.5
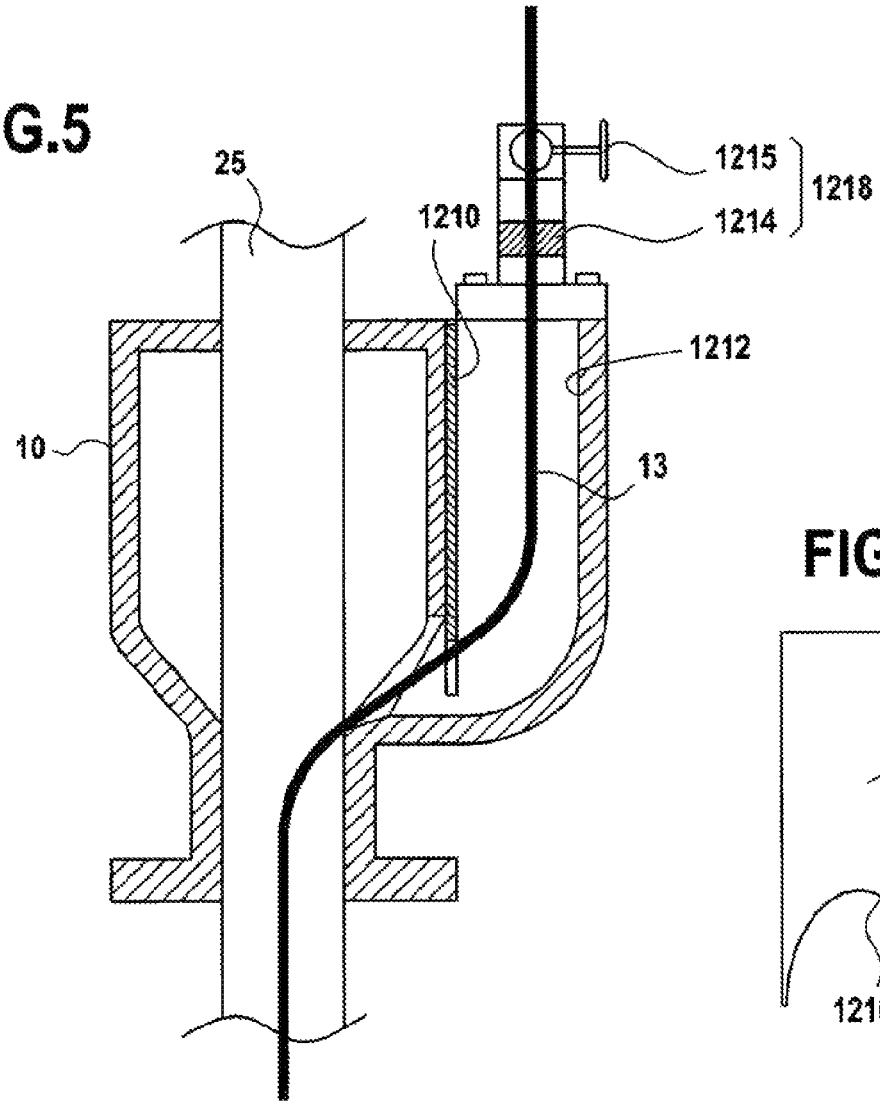
FIG.6
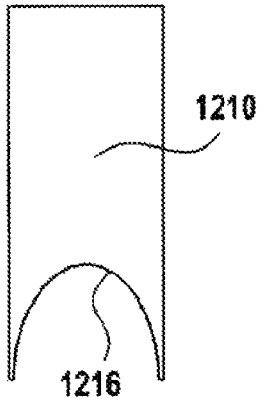
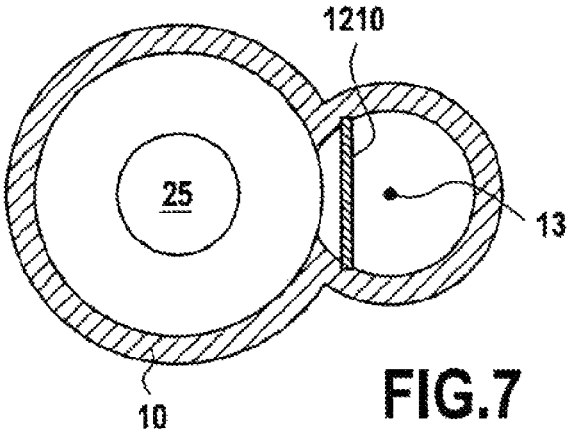
FIG.7

METHOD AND APPARATUS FOR INSTALLING A WIRELINE FOR LOGGING OR OTHER OPERATIONS IN AN UNDER-BALANCED WELL

INTRODUCTION

The invention relates to a well-logging technique and apparatus for accomplishing such logging without killing the well which has been horizontally drilled using under-balanced drilling techniques; more specifically, a process and apparatus for rigging up and completing wireline logging operations in a horizontal well drilled using an under-balanced drilling technique without killing the well by selectively introducing logging tools into an under-balanced well bore through a dual throated blow out preventer.

BACKGROUND OF INVENTION

When drilling deviated or horizontal wells, conventional overbalanced drilling typically kills the well in older or lower production zones, making conventional logging techniques difficult to accomplish. Different techniques have been developed to circumvent this problem by using underbalanced techniques and sealing around the pipe and wireline cable for example thereby permitting gas insertion into the well bore annulus, logging while drilling (LWD), memory shuttles conveyed by pumping them down inside pipe or using slim tools such as RST conveyed with cable inside drill pipe. So far as known to applicant, the problems with conveying a full suite of open hole logging tools in an under-balanced horizontal well remained unsolved until the filing of applicant's companion application in the European Patent Office under Serial No. EP082901261 on or about 19 Mar. 2008, which application is incorporated herein by reference as if copied herein.

Horizontal wells are a commonly used technique in the industry. Horizontal wells enable a long interval of reservoir to be contacted in a single well thereby improving the productivity and enhancing reservoir recovery economics. Horizontal well logging techniques have also evolved. While drilling measurements allow accurate well placement, in certain types of reservoirs and depending on the evaluation objectives requested by the owner, there still remains a strong need to perform wireline logging operations involving high resolution imaging, magnetic resonance measurements, as well as downhole fluid analysis and sampling services—most of which are currently not available with LWD. For such cases, the industry has developed a method conveniently termed in current literature as "tough logging conditions" (TLC) which enables the tools to be conveyed on drill pipe while also maintaining an electrical connection to the surface unit using a standard wireline cable. The method, in summary, involves conveying tools in the well using drill pipe till just above the last casing shoe. A cable side door entry sub is then inserted in drill string to allow the cable to be rigged up and to enter inside the drill pipe through the side entry sub and further connect to the tools already down hole. The cable is tied up or fixed at the side entry sub and both cable and drill pipe are simultaneously conveyed down to perform logging operations. A standard feature of a TLC system is that a certain length of cable, equal to a minimum of the length of the logging interval, is carried on the drillstring outside the drillpipe located between the rig floor and the point in the drill string where the cable enters the drill pipe, that is, at the side entry sub.

Under-balanced drilling is especially suited for horizontal wells because formation damage in horizontal over-balanced wells can be very significant due to the long contact length and contact time between reservoir rocks and drilling fluids as well as constant scraping of filter cake by the drill pipe lying down on the low side of the horizontal. As a result, significant productivity is lost due to formation damage in horizontal wells. The industry has therefore realized the need to design technologies that are able to perform under-balanced drilling in horizontal wells to lower the formation damage that would otherwise be caused if the well was drilled over-balanced and thereby achieve higher productivity.

The main objective of this invention is therefore to provide an improved apparatus and methods for inserting a wireline through a blow out preventer stack, including either a rotating blow out preventer or snubbing preventer, to perform the equivalent of a TLC logging operation in an under-balanced horizontal well.

SUMMARY OF INVENTION

A dual throated blow out preventer provides a body having two parallel channels; a sealing element moveable into said body to selectively separate the two channels into a first sealable conduit and a second sealable conduit, whereby the sealing element can be inserted into the body to separate a wireline into the first sealable conduit from a drill string in the second sealable conduit, both of which are disposed in the blow out preventer. The sealing element can be an insert slideably engaging said body and providing an arcuate lower end. Alternatively, the sealing element can be a rotatable slotted liner, which provides a longitudinal slit permitting the movement of a wireline rope into and out of the sleeve; and, means for rotating said sleeve after insertion of a wireline. Both forms of the sealing element can be manipulated to permit the insertion of the wireline and drill string into the blow out preventer, permitting both the wireline and the drillstring to be sealed to well pressures independent of each other.

A method of inserting a wireline into a dual channel blow out preventer can be described in the following steps: closing a pressure isolation valve in a well bore; rigging up wireline tools on a rotary floor; reeving a wireline through a wireline packoff assembly and a cable entry sub, building a rope socket and making up a pump down wet connector; connecting a downhole wet connector head to tools and making up a drill pipe; running the assembly containing the wireline tools into to a position above the pressure isolation valve; moving the pump down wet connector head into the drill pipe and making up the cable side entry sub to the drill string; pumping the pump down wet connector head into the well bore and latching to the downhole wet connector head; slacking off the wireline and tying the wireline to the cable side entry sub; moving the drillstring to a position that the cable side entry sub is below the blow out preventer; moving the cable into a wireline channel fabricated in the blow out preventer; manipulating a sealing element in the rotating blow out preventer to separate the wireline channel from the drill string channel closing the seals on the wireline packoff and the blow out preventer; and, equalizing the pressure in the drill string with the pressure at the pressure isolation valve (PIV). This method thereby permits the logging of a horizontal well in an underbalanced state with current logging technology, which has heretofore been difficult to achieve.

BRIEF DESCRIPTION OF THE DRAWINGS

FIG. 5 is a schematic view of an alternative dual-throated blow out preventer permitting a wireline and a tubular drillstring to be inserted in the blow out preventer.

FIG. 6 is a schematic view of the separating gate used to separate the dual-throated blow out preventer into separate channels.

FIG. 7 is a schematic cross-sectional view of the dual-throated rotating blow out preventer showing the separation of the channels for the tubular string and for the wireline.

DETAILED DESCRIPTION OF AN EMBODIMENT

The logging of deviated or horizontal wells using a drillstring to set the logging tool string in place has been more fully described in U.S. Pat. No. 5,871,052, the contents of which are fully incorporated herein by reference as if copied herein verbatim. In the present inventive method, the logging tool string must be rigged up and lowered into the well bore while maintaining the underbalanced well bore at its underbalanced pressure but without killing the well by pumping in a mud column to contain the downhole pressure. The present invention relates to an improved method of stringing the wireline through the pressure control devices at the rig floor to make this technique easier and faster to accomplish.

Figure 1:
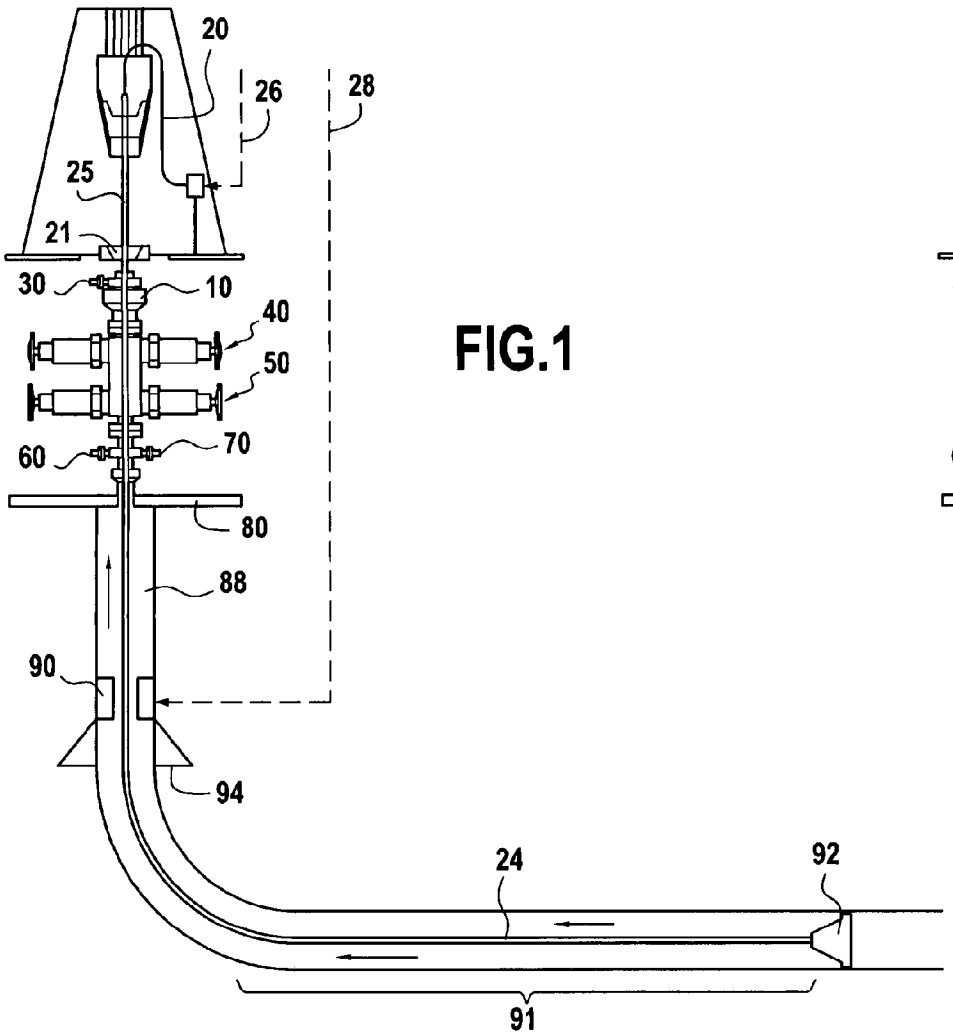
FIG. 1 is a schematic view of the surface equipment typically found in an underbalanced drilling operation.

As can be readily seen in FIG. 1, the principal issues for underbalanced drilling (UBD) is the maintenance of pressure at the surface while controlling the well from kicking or blowing out. Accordingly, the safety needs at the surface must be counterbalanced with the need to maintain only so much pressure on the well bore as is required to contain the natural pore pressure within the well bore. Pressure is managed by an annular rotary blow-out preventer 10 which allows drillstring 25 to be inserted or snubbed into the well bore (not shown) under pressure and yet permit rotation of the drillstring 25 by the rotary table 21, as required. Mud line 20 can also be used to provide additional pressure control as needed. Mud return line 30 takes returning mud, produced fluids and gases to the separators and phase control devices normally associated with UBD. Blind rams 40 and shear rams 50 are typically placed in the blow out preventer stack 10 to prevent accidental blowouts, all in a manner well known in the drilling art. Kill line 60 and choke line 70 complete the well head assembly for a typical underbalanced stack above the ground level 80. Nitrogen ($N_2$) can be added either through injection into the mud line 20 or by a parasitic line into the casing annulus 88, both in a manner well known in this art. For example, a pressure isolation valve 90 can be disposed in the casing adjacent the casing shoe 94 and can be selectively opened and closed to maintain pressure in the open hole portion 91 of the well bore. Additional problems in underbalanced drilling offshore are not discussed herein, but existing technology could be adapted using the disclosure contained herein to permit logging an offshore underbalanced well with the methods described herein without departing from the spirit or intent of this invention.

Figure 2:
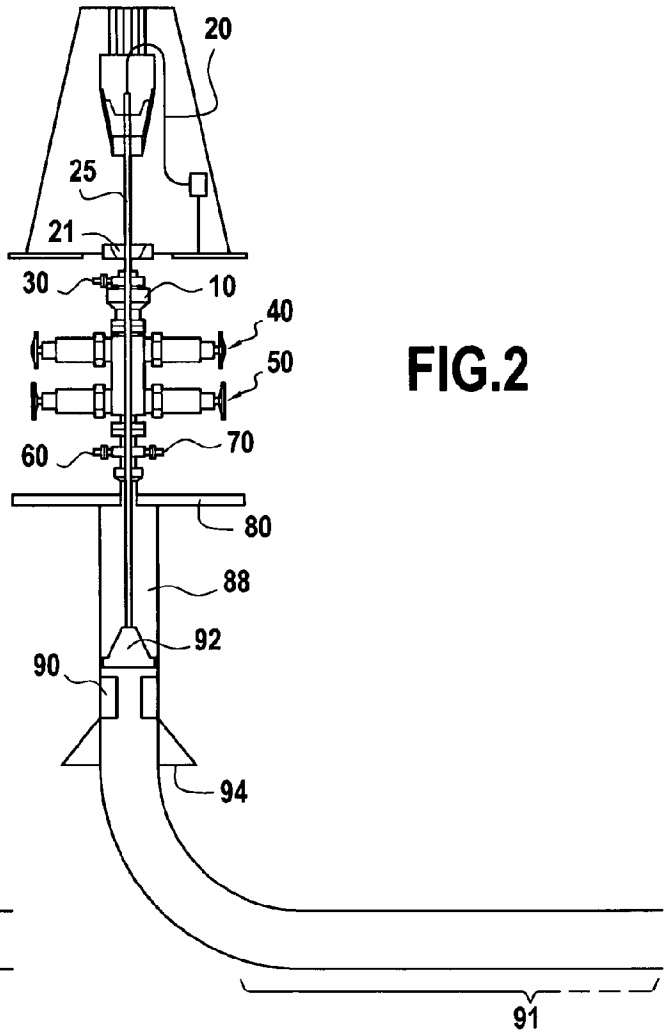
FIG. 2 is a schematic view of the underbalanced drilling operation tripping the bottom hole assembly past the pressure isolation valve and closing the PIV to maintain the underbalanced state of the open hole portion of the well bore.

FIG. 2 shows the stage of the deployment of the present invention after the drill bit 92 is withdrawn past the pressure isolation valve (PIV) 90 when tripping out of the well bore. After the PIV 90 is closed, $N_2$ is stopped and pressure is bled off the upper portion of the casing string and the rotary blow out preventer 10 is opened. Mud return 30 will reflect the decline in pressure and stop flowing after the pressure is bled off. Normal tripping of the drillstring can be completed, making the well ready either for further drilling; or, for the installation of the logging string into the open hole 91 of the well bore.

Figure 3:
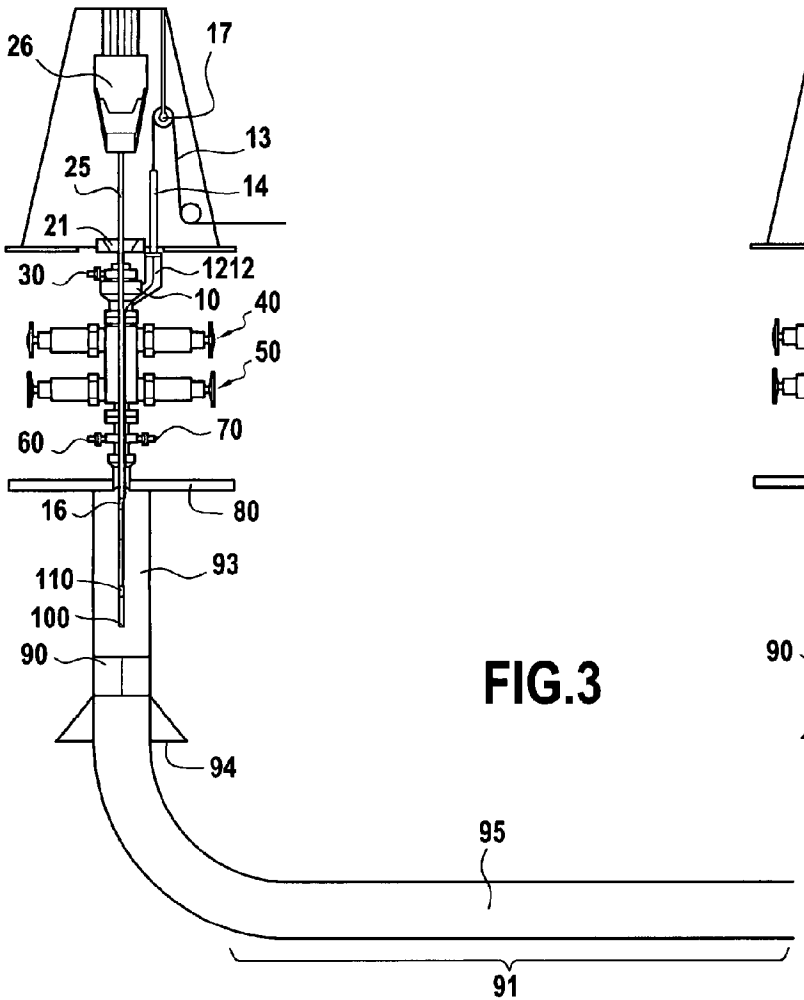
FIG. 3 is the schematic view of pressure adjustment in the casing string in preparation for opening the PIV and going into the well to total depth.

FIG. 3 discloses the rigging up of the logging string 100 which can facilitate advanced logging operations, such as high resolution imaging, production logging and other features not normally available using logging while drilling as shown in the companion application incorporated herein (EP08290261). These advanced techniques allow the well owner to determine the true productivity potential of the well, among other reservoir characterization related benefits. This logging operation facilitated by this method permits the driller to optimize design of the well completion profile, not previously available, thereby increasing total recovery from the well. The logging string 100 required by the operator is inserted in the well bore 88 and connected at its proximal end with a downhole wet connector head (DWCH) 110, which provides a box end for connection to a drillstring. The DWCH 110 also provides a float valve, which can act like an internal blow out preventer (BOP) providing additional protection to the rig floor, while allowing circulation of mud and $N_2$ into the well bore. The DWCH 110 further provides a male wet connector for union with a pump down connector head, which provides an electrical connection to the logging string attached to the DWCH, all as more fully described in the companion application (EP08290261).

Figure 4:
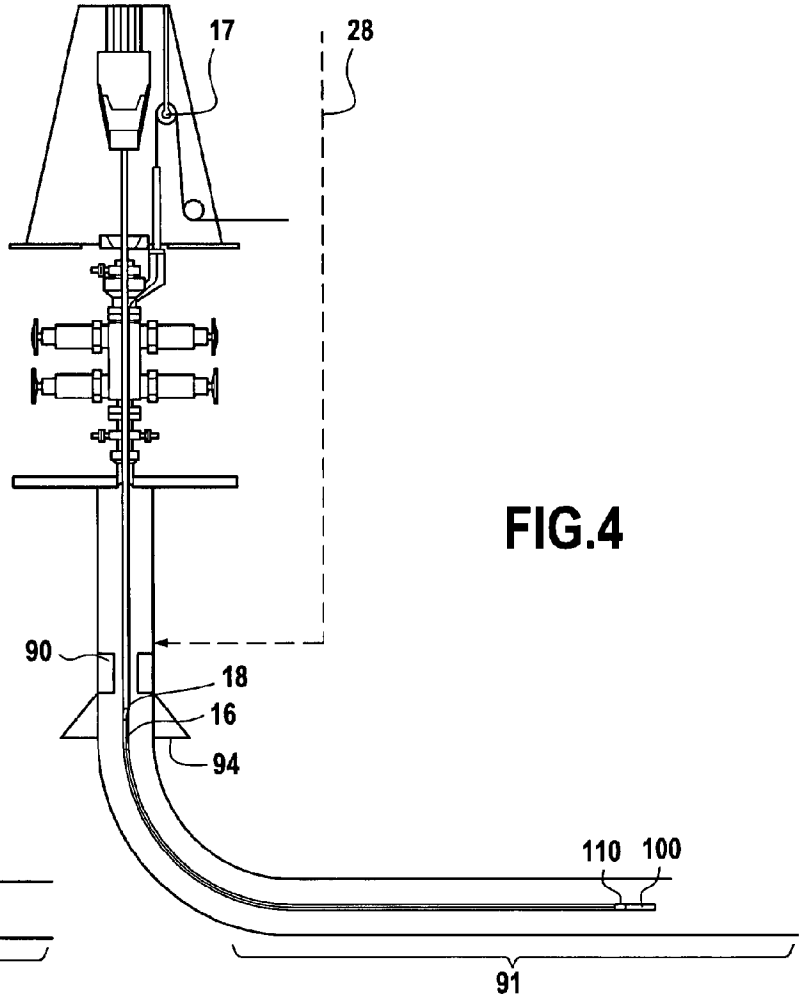
FIG. 4 is a schematic view of the completed assembly being run into the well bore to total depth in preparation for pulling the logging string back out of the well bore to log the open hole portion of the well.

The rigging up of the electrical wireline through a lubricator system for this improved method and apparatus is made on the rig floor above the rotary blow out preventer 10. As shown in FIG. 4, electrical wireline cable 13 is threaded through the sheave 17 into the lubricator 14, then up through the open rotary blow out preventer 10. The wireline cable 13 is then put into the drill pipe through a cable side entry sub (not shown in detail). A pump down wet connector head (PWCH) is attached and a float valve is placed to close the PWCH in the drillstring. The rams in the blow out preventer can be closed as a backup safety measure while this rigging up occurs.

Lubricator 14 can provide a wireline packoff and wireline blow out preventer to seal against pressure and pressure surges experienced by the well while logging takes place. The entry point for the wireline cable is a channel fabricated into a rotary blow out preventer body and providing means for connection of the lubricator and the packoff above the rotary floor. Once the float valve is attached to the top of the cable side entry sub, additional drill pipe can be connected into the drillstring assembly, the pipe rams can be opened and the float valve/cable side entry sub moved below the rotary blow out preventer. Pressure control is thus maintained over the drillstring through the mud line and the casing string below and over wireline through the lubricator 14. The pump down wireline connect head is sent down either by gravity or slight pump pressure to mate with the downhole wet connect head attached to the logging string.

Once the connection between the PWCH and the DWCH is made and tested, the electrical wireline cable is slacked off sufficiently into the drillstring to prevent premature connector separation. The operator would then pull the drillstring up to the rig floor and the cable would be affixed by banding or other means well known to those in this art to the cable side entry sub.

Then, as shown in FIG. 3, the drillstring 25 is lengthened by adding additional drill pipe sections and the logging assembly 100 is moved to its position adjacent the pressure isolation valve PIV 90 which has remained closed while introducing additional cable length into well bore. Mud and $N_2$ are added to the casing annulus 93 to bring the pressure to approximate the open hole pressure 95 to avoid shocking the well or killing the well, that is, to match the downhole formation pressure in the underbalanced portion of the well. At this point, the PIV 90 would be opened and the logging string would be moved by manipulation of the drillstring 25 into the well bore to total depth together with the simultaneous and coordinated insertion of additional cable length.

It is generally expected that the distance from the downhole wet connector head to the side entry sub will be long enough to protect the wireline cable which is run inside the drillstring from the side entry sub to the wet connect to completely log the open hole portion 91 of the well bore, all as more fully shown in FIG. 4. This will protect the wireline from damage from formation collapse or scuffing as it runs in the horizontal portion of the well below the casing shoe 94, outside of the casing.

As may be readily appreciated in FIG. 4, the wireline cabling 18 runs on the exterior of the drillstring 25 until it enters the drillstring at the cable side entry sub 16 (CSES.) Once the required bottom logging interval depth is experienced by the logging string 100, the operator withdraws the drillstring 25 in coordination with the wireline operator to move the logging string through the open hole portion 91 of the well bore to accurately log the well in its underbalanced condition.

To accomplish the foregoing invention, the wireline 13 must be readily inserted below the rotating blow out preventer 10 rams to be connected to the logging string on the drill pipe. FIG. 5 shows an embodiment of a improved preferred embodiment of the wireline entry guide channel 1212 fabricated in a rotating blow out preventer body 10, providing hydraulic actuation and rotating members 1215 well known in this art. The wireline guide channel 1212 accepts lubricator 1214 to admit the wireline 13 through standard wireline pressure control devices or packoffs 1218. The opening to drill pipe 25 is pressure controlled by the hydraulically actuated rubber members, in a manner well known in this industry and the wireline is sealed to pressure by the wireline lubricator and packoff assembly 1214 and 1215, collectively 1218.

FIG. 5 shows the wireline isolated back through the rotating blow out preventer in its channel. In this embodiment, the rotating blow out preventer provides a dual channel or throat through which both a tubular string and a wireline can be inserted simultaneously. After the PIV 90 is closed, as shown in FIGS. 2 and 3, and pressure is equalized in the cased portion of the well, the wireline tools described above can be assembled and the wireline reeved into the wireline packoff assembly after the rope socket and pump down wet connector head (PWCH) are attached. The assembly is then pumped down to connect to the DWCH, which is then lowered into well bore to make up the completed drillstring in the well bore at a position above the PIV 90. The entire assembly is moved so that the cable side entry sub (CSES) is below the rotating blow out preventer RBOP, then the cable is manipulated into its separate channel and the sealing element 1210 is placed into the RBOP to separate the cable entry channel 1212 from the drillstring portion of the RBOP 10. A wireline packoff 1214 and ball valve 1215 assembly is installed over the wireline channel of the RBOP 10. When wireline operations are not in progress, the dual channel can be plugged at either the top of the packoff with a ball valve or the like or at the top of the blow out preventer with a standard blanking plug (not shown).

FIG. 6 is a side view of the sealing element 1210, which is placed into the RBOP 10 to separate the wireline channel from the drillstring channel. Sealing element 1210 has a lower end 1216, which is curved or arcuate to accommodate the wireline 13 without crushing or damaging the wireline cable as it is moved through its separate channel of the RBOP.

FIG. 7 is a cross sectional view of the dual throated RBOP body with the sealing element 1210 engaged to separate the two channels. Tubular string 25 can be moved independently of wireline 13, although in normal operation the wireline operator coordinates the movement of the wireline with movement of the drillstring to prevent separation of the tools from the wireline.

Figure 8:
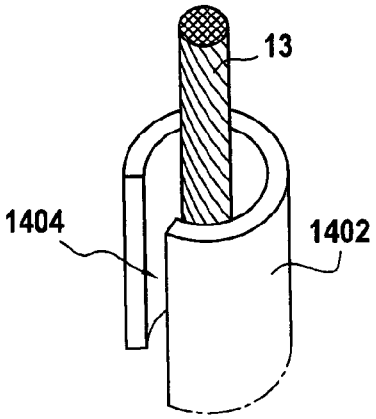
FIG. 8 is a partial schematic perspective view on another embodiment showing a rotating slotted liner for use in disposing both a tubular string and a wireline down through a blow out preventer.

FIG. 8 is another embodiment showing a rotatable slotted liner sleeve 1402, which allows the wireline 13 to be moved into the rotatable liner sleeve 1402, which can then be rotated in the RBOP 10 to close off the opening 1404.

Figure 9:
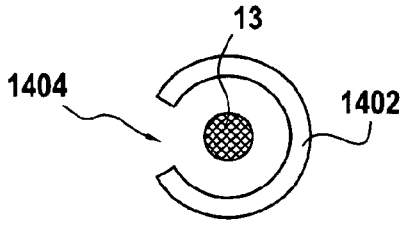
FIG. 9 is a cross sectional view of the rotating slotted liner for use in a blow out preventer accommodating both a wireline and a tubular string in separate channels.

FIG. 9 is a cross sectional top view of this rotating slotted liner 1402. Once the wireline is isolated in the slotted channel, the liner is moved to encapsulate the wireline wholly within the wireline channel of the RBOP.

Figure 10:
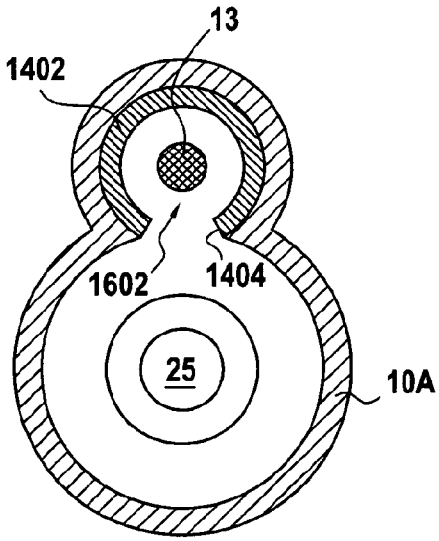
FIG. 10 is a top sectional schematic view of a dual channel blow out preventer providing a wireline channel wall liner to isolate the wireline channel from the drillstring channel of the blow out preventer in the open position.

FIG. 10 shows the cross sectional view of the rotating slotted liner 1402 in its open position enclosing wireline 13. Once the side entry sub is attached to the wireline 13 and run into the casing, the wireline 13 can be moved completely into the wireline channel 1602 and the rotatable sleeve 1402 rotated to its closed position thereby isolating the wireline 13 from the main throat 1601 of the RBOP 10A.

Figure 11:
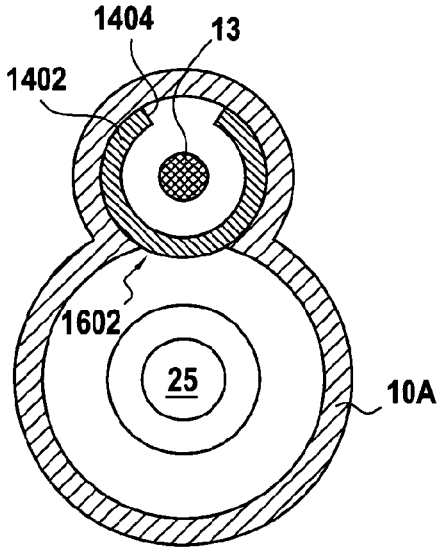
FIG. 11 is a top sectional schematic view of a dual channel blow out preventer providing a wireline channel wall liner to isolate the wireline channel from the drillstring channel of the blow out preventer in the closed position.

FIG. 11 shows the cross sectional view of the wireline 13 isolated fully within the wireline channel 1602 of the RBOP 10A after closing the rotating sleeve arrangement. Rotation of the slotted liner 1402 from the open to the closed position can be either manual or mechanical, including by hydraulic actuation, all in a manner well known in this industry. Standard pressure control devices or packoffs can also be installed on the wireline channel to control pressure through the wireline entry port in a manner well known to those skilled in this art.

After each of these assemblies is complete and the dual throat of this embodiment is closed to separate the wireline from the drillstring path of the RBOP, the pressure can be increased from the surface to match the conditions experienced at the PIV 90 of FIGS. 1-4. Since both channels in the closed position, even at the higher well pressures, are in equilibrium, no unusual seal need be placed between the two channels in operation. Both channels must be sealed independently from well pressure in a manner well known in the drilling industry.

Numerous embodiments and alternatives thereof have been disclosed. While the above disclosure includes the best mode belief in carrying out the invention as contemplated by the named inventors, not all possible alternatives have been disclosed. For that reason, the scope and limitation of the present invention is not to be restricted to the above disclosure, but is instead to be defined and construed by the appended claims.

The invention claimed is:

1. A method of inserting a wireline into a dual channel rotating blow out preventer comprising:

closing a pressure isolation valve in a well bore;

rigging up wireline tools on a rotary floor;

reeving a wireline through a wireline packoff assembly and a cable side entry sub;

connecting a downhole wet connector head to tools and making up drill pipe;

running an assembly containing the wireline tools to a position above the pressure isolation valve;

connecting the downhole wet connector head to the wireline such that communication and power may be transmitted to or from Earth's surface;

slacking off the wireline and tying the wireline to the cable side entry sub;

moving the drillstring to a position that the cable side entry sub is below the rotating blow out preventer;

moving the wireline into a wireline channel fabricated in the rotating blow out preventer;

manipulating a sealing element in the rotating blow out preventer to separate the wireline channel from a drillstring channel;

closing the seals on the wireline packoff assembly;

closing the seals on the rotating blow out preventer;

equalizing pressure in the drillstring channel with the pressure at the pressure isolation valve; and inserting the drillstring into the well under pressure while rotating the drillstring.

2. The method of claim 1 further comprising using the sealing element to seal the wireline and the drillstring to pressures independent of each other.

3. The method of claim 1 wherein the downhole wet connector head is attached to a logging string.

4. The method of claim 1 wherein the wireline is sealed to pressure by a wireline lubricator and the wireline packoff assembly.

5. The method of claim 1 further comprising operating the rotating blow out preventer with an underbalanced well.

6. A method of inserting a wireline into a dual channel rotating blow out preventer comprising:

closing a pressure isolation valve in a well bore;

rigging up wireline tools on a rotary floor;

reeving a wireline through a wireline packoff assembly and a cable side entry sub;

connecting a downhole wet connector head to tools and making up drill pipe;

running an assembly containing the wireline tools to a position above the pressure isolation valve;

connecting the downhole wet connector head to the wireline such that communication and power may be transmitted to or from Earth's surface;

slacking off the wireline and tying the wireline to the cable side entry sub;

moving the drillstring to a position that the cable side entry sub is below the rotating blow out preventer;

moving the wireline into a wireline channel fabricated in the rotating blow out preventer;

manipulating a sealing element in the rotating blow out preventer to separate the wireline channel from a drillstring channel;

closing the seals on the wireline packoff assembly;

closing the seals on the rotating blow out preventer;

equalizing pressure in the drillstring channel with the pressure at the pressure isolation valve; and operating the rotating blow out preventer with an underbalanced well.

7. The method of claim 6, further comprising using the sealing element to seal the wireline and the drillstring to pressures independent of each other.

8. The method of claim 6, wherein the downhole wet connector head is attached to a logging string.

9. The method of claim 6, wherein the wireline is sealed to pressure by a wireline lubricator and the wireline packoff assembly.

* * * * *